US011331671B2

(12) United States Patent
Klaassen

(10) Patent No.: US 11,331,671 B2
(45) Date of Patent: May 17, 2022

(54) SAMPLE TAKING KIT AND METHOD FOR COLLECTING A SAMPLE USING SUCH A KIT

(71) Applicant: DAKLAPACK EUROPE B.V., Lelystad (NL)

(72) Inventor: Dave Willem Klaassen, Ermelo (NL)

(73) Assignee: DAKLAPACK EUROPE B.V., Lelystad (NL)

( * ) Notice: Subject to any disclaimer, the term of this patent is extended or adjusted under 35 U.S.C. 154(b) by 151 days.

(21) Appl. No.: 16/486,207

(22) PCT Filed: Feb. 15, 2018

(86) PCT No.: PCT/NL2018/050102

§ 371 (c)(1),
(2) Date: Aug. 15, 2019

(87) PCT Pub. No.: WO2018/151595

PCT Pub. Date: Aug. 23, 2018

(65) Prior Publication Data

US 2020/0001289 A1 Jan. 2, 2020

(30) Foreign Application Priority Data

Feb. 16, 2017 (NL) ..... 2018387

(51) Int. Cl.
*B01L 3/00* (2006.01)
*B01L 9/06* (2006.01)

(52) U.S. Cl.
CPC ..... *B01L 3/5055* (2013.01); *B01L 3/5082* (2013.01); *B01L 9/06* (2013.01); *B01L 2200/025* (2013.01);

(Continued)

(58) Field of Classification Search
None
See application file for complete search history.

(56) References Cited

U.S. PATENT DOCUMENTS 4,150,950 A * 4/1979 Takeguchi ..... B01L 3/5082 422/500
4,418,040 A * 11/1983 Karamian ..... B01L 9/00 248/125.1

(Continued)

FOREIGN PATENT DOCUMENTS

EP 2 737 951 A1 6/2014
EP 2737951 A1 * 6/2014 ..... B01L 9/06
WO WO 97/19335 A1 5/1997

OTHER PUBLICATIONS

International Search Report, issued in PCT/NL2018/050102, dated Apr. 3, 2018.

(Continued)

*Primary Examiner* — Matthew D Krcha
(74) *Attorney, Agent, or Firm* — Birch, Stewart, Kolasch & Birch, LLP

(57) ABSTRACT

A sampling kit includes firstly a sample tube, which includes a container part for holding a sample and a cap for sealing the container, and secondly a plastic foil instruction sheet. The sheet provides information related to a sample taking process using of the sample tube, which information is printed thereon or is provided in the form of one or more documents held in one or more pockets thereof. The sheet is provided with a support body for holding the sample tube, or at least a container part of the sample tube, during the sampling taking process, the support body and the bottom end of the sample tube being shaped such that they cooperate, to support the sample tube in an upright position.

20 Claims, 5 Drawing Sheets

(52) U.S. Cl.
CPC ... *B01L 2200/185* (2013.01); *B01L 2300/043* (2013.01); *B01L 2300/123* (2013.01)

(56) References Cited

U.S. PATENT DOCUMENTS

| | | | | |
|---|---|---|---|---|
| 5,720,406 | A * | 2/1998 | Fassbind | B01L 3/50851 220/23.4 |
| 6,660,232 | B1 * | 12/2003 | Krueger | B01L 3/5085 422/500 |
| 2009/0004064 | A1 * | 1/2009 | Liu | B01L 3/5085 422/400 |
| 2014/0027342 | A1 * | 1/2014 | Pawlowski | A61J 1/14 206/570 |
| 2014/0243706 | A1 | 8/2014 | El-Fahmawi | |
| 2018/0043365 | A1 * | 2/2018 | Ruby | A61B 10/0096 |

OTHER PUBLICATIONS

Written Opinion if the International Searching Authority, issued in PCT/NL2018/050102, dated Apr. 3, 2018.

* cited by examiner

SAMPLE TAKING KIT AND METHOD FOR COLLECTING A SAMPLE USING SUCH A KIT

It is known to provide persons with a sampling kit comprising an instruction sheet and a sample tube to enable that person to collect a sample. The sample tube is provided for storing the sample, and the instruction sheet for instructing that person, typically a person that is not experienced with collecting samples, on how to correctly collect the sample. For example, a sampling kit can be provided by a general practitioner to enable a patient to collect at home a stool sample for medical examination, which sample is subsequently sent by mail to the laboratory for examination. Also, known sampling kits are distributed by post amongst a selected demographic of the population as part of a medical screening.

A sampling kit comprising an instruction sheet and a sample tube for enabling a nonprofessional user to collect a sample, is for example known from EP2737951.

Due to demographic changes, screenings for medical examination of the older population, in particular of persons above 65, have become more common. Drawback is, that the test subjects often are elderly people with no experience in collecting biological samples. Furthermore, the kits comprise multiple components and present the user with extensive information and therefore may be complicated to use.

Any improvement in ease of use, i.e. in providing the person with organized information, or in improved handling of the sample tube, is welcome.

The aim of the invention is to provide an alternative sampling kit that enables a person to collect a sample, more in particular an improved sampling kit, i.e. a sampling kit further facilitates the sampling process, i.e. the process of taking a sample.

The invention therefore provides a sampling kit according to claim 1.

A sampling kit according to claim 1 comprises:

a sample tube, the sample tube comprising a container part for holding a sample and a cap for sealing the container;

a plastic foil instruction sheet, which instruction sheet provides information related to a sample taking process that involves use of the sample tube, which information is provided in the form of one or more documents held in one or more pockets of the instruction sheet and/or is printed on the instruction sheet;

wherein the instruction sheet is provided with an injection molded support body adapted to engage the bottom end of the sample tube for supporting the sample tube in an upright position.

Instruction sheets configured for holding a sample tube for collecting a sample, i.e. to enable transportation of the kit, are known form the prior art. However, in the prior art, during the sampling taking process, the sample tube is separated from the instruction sheet to be held by hand.

According to the invention, the instruction sheet is provided with a support body for holding the sample tube, or at least a container part of the sample tube, during the sampling taking process.

According to the invention, the support body and the bottom end of the sample tube are shaped such that they cooperate, i.e. have corresponding shapes that enable the bottom end of the sample tube to be received in, or at least to be coupled with, the support body, to enable the support body to support the sample tube in an upright position.

By securing the sample tube onto the instruction sheet, more in particular by supporting the sample tube in the upright position, the sample tube is always readily available for a user in the process of taking a sample. Thus, picking up the sample tube, or the container of the sample tube, is made easy. It is submitted in this context that sampling tubes typically have an elongated shape, which does not allow them to be set up on a support surface in a stable, upright position.

The invention furthermore allows for a person collecting a sample to pick up the sample tube, or the container of the sample tube, during the sampling taking process, for example to remove from or mount onto the container a cap, or to insert the sample into the container, if the person wishes to do so.

During the sampling process, the instruction sheet can be used to present the sample tube to the user and, optionally, and to position the sample tube during the sample taking relative to the relevant information provided on or in the instruction sheet.

Also, by positioning the sample tube in the upright position a sample can be inserted in the tube, and the person taking the sample does not need to hold or pick up the tube during or after collecting the actual sample to insert it into the tube.

With an instruction sheet according to the claimed invention, the sample tube is thus readily available to the user, optionally in such a way that relevant information on the instruction sheet is not blocked from view and/or is presented in a controlled way relative to the sample tube.

Thus, the invention provides an alternative sampling kit which facilitates the sample taking process, more in particular, that facilitates collecting the sample.

An instruction sheet according to the claimed invention is a flexible plastic sheet material. The sheet material can be transparent.

In an embodiment, the instruction sheet is provided with information printed on the sheet. The information preferably relates to the use of the sample tube to inserted in the support body. For example, sequential steps of a sample taking process can be indicated.

In an embodiment, the instruction sheet is configured of sheets of plastic material, sealed together such that multiple pockets are created. In an embodiment according to the invention, a strip of pockets is provided. In another embodiment, for example an A4 sized sheet is provided with a grid, i.e. one or more rows and one or more columns, of multiple pockets.

The pockets can be used for holding leaflets, brochures, etc. for providing information and/or instructions, and other components that can be used in the sample taking process, for example an envelope for returning the sample tube containing the sample by post, gloves for holding the sample tube while taking a sample, etc.

In an embodiment, the instruction sheet comprises a pocket for holding sample tube, preferably a pocket dimensioned for securely holding the sample tube, i.e. for securing the sample tube relative to the sheet.

The pockets of the instruction sheet can be provided with flaps or lids for closing or sealing the pockets, preventing the contents drop out of the pockets during transport and or to prevent the leaflets, brochures, etc. to get rearranged during transport.

In an embodiment, the instruction sheet comprises a single pocket and a flap for sealing the single pocket. In such an embodiment, the instruction sheet may be configured for use as an envelope, preferably a postal envelope. Thus, the instruction sheet can also be used for sending the sample the sample to for example a laboratory.

In an embodiment, the instruction sheet is provided in the form of a multi pocket instruction sheet, or, in other words, a multi pocket instruction bag, the multi pocket instruction sheet comprising multiple pockets for each holding an instruction sheet and/or a sample tube. Multi pocket instruction sheets are known from the prior art. the instruction sheet is a multi-pocket instruction sheet, In an embodiment, the instruction sheet is configured for presenting instructions and a sample tube to a nonprofessional user in an ordered, predetermined sequence, thus guiding said user through the process of taking a sample. In a preferred embodiment, the instruction sheet is embodied as a multi pocket instruction sheet, wherein different pockets relate to different stages in the sample taking process.

In an embodiment, the multi pocket instruction sheet, preferably the pockets of the multi pocket instruction sheet, are provided with signs and/or symbols and/or letters and/or numbers and/or pictures, that indicate the user in which sequence the pockets, more in particular the content of the pockets, have to be consulted and/and or are to be used.

In an embodiment, the pockets of the multi pocket instruction sheet are provided such that one or more of the pockets, the pockets holding instructions and/or a sample tube, can be folded upon one another to provide the multi pocket instruction sheet with a compact configuration and thus facilitate transport, for example transport by post.

In an embodiment, the instruction sheet can be folded between the compact configuration, in which it fits into a regular postal envelope, and an unfolded configuration, in which it does not fit into the regular postal envelope. In the unfolded configuration, the instruction sheet can be laid down on for example a table surface to present a user with the information held in the pockets and/or printed on the instruction sheet.

According to the invention, the instruction sheet is provided with a support body for holding the sample tube, or at least a container part of the sample tube, during the sampling taking process. The support body and the bottom end of the sample tube are shaped such that they cooperate, i.e. have corresponding shapes that enable the bottom end of the sample tube to be received in, or at least to be coupled with, the support body, to enable the support body to support the sample tube in an upright position.

In an embodiment, the support body is for example a pin that is received in a recess in the bottom of the container of the ample tube. In an alternative embodiment, the support body comprises multiple click fingers for engaging recesses in the bottom end of the test tube, more in particular the bottom end of the container of the test tube.

In an embodiment, the support body has a bottom surface, for placement on a support surface, and the support body is fixed in, or onto, the sheet such that the bottom surface of the support body extends in a direction parallel to the sheet, more in particular parallel to a surface of the sheet. Thus, when the instruction sheet is for example laid out on a support surface, such as a table top, the bottom surface is supported by the table top, and thus provides the support body with extra stability.

In a further embodiment, the bottom surface has an outer contour having a diameter D, which diameter preferably is at least one and a half times the cross section of the sample tube to be held by support body. In a preferred embodiment, the cross section is a circular, square or cross shaped cross section, preferably configured to support the sample tube at its center to provide optimal stability. In an alternative embodiment, the support surface can for example be C-shaped, L-shaped. It is submitted that the support body being coupled with the instruction sheet provides the support body with additional stability. Thus, the support surface of the support body, can be relatively small and/or does not need to be symmetrical with respect to the sample tube to provide stability.

In an embodiment, the support body defines a sample tube receiving space for receiving the bottom end of the sample tube, and defines an insert opening for inserting the bottom end of the sample tube into the receiving space, which insert opening is dimensioned such that, when the bottom end of the sample tube is inserted in the receiving space, the support body engages the outside surface of the sample tube to provide support for the sample tube in a lateral direction. The bottom end of the receiving space may be open, or may be sealed by the sheet.

In an embodiment, the receiving opening of the support body is spaced, in a direction perpendicular to the support surface, at a height H, the height H being at least 0.5 cm. The optimal depth of the receiving space, as well as the diameter of the support surface, typically depend on the dimensions of the test tube. It is submitted that the skilled person, based on the information provided herein, is able to provide a support body with dimensions that allow for it to support the sample tube of the kit in an upright position.

In an embodiment, the support body has one or more engagement surfaces for engaging the outer surface of the sample tube, which engagement surfaces define a contour of the insert opening. The contour of the support opening may be continuous, e.g. the contour of the insert opening can be an annular contour, for example when the receiving space is provided in the form of a cylindrical shaped recess in the support body. In an alternative embodiment, the contour may be discontinuous, for example when the support body comprises three or more upright pins or fingers that are grouped such that they between them define a receiving space for inserting the bottom end of the sample tube.

In an embodiment, the contour of the insert opening is dimensioned for clamping the sample tube in the insert opening, and preferably, the support body, or a section thereof, is flexible and/or the insert opening is provided with a flexible material, e.g. a rubber ring extending along its inside contour, to provide an additional clamping force.

As an alternative, or in addition, the bottom end of the sample tube can be provided with a shape the allows for the test tube to be fixed in the support body by friction. For example, the sample tube can be provided with a rubber tip, or with an annular rib, making the bottom end of the sample tube, or at least a section of the bottom end wide enough relative to the cross section of the receiving space to be secured by friction in that receiving space by inserting the bottom end into the receiving space.

The support body can be mounted in the instruction sheet in many different ways. In an embodiment, the support body is simply adhered to the sheet, preferably by providing an adherent to a bottom surface of the support body. In an alternative embodiment, the instruction sheet comprised a front sheet and a back sheet, and part of the support body, preferably a planar flange shaped foot part of the support body, is received between the two sheets, while part of the support body, preferably a neck shaped part configured to receive the bottom end of the sample tube, protrudes through an opening in the front sheet. For example, the front sheet may be the front of a pocket, with the foot of the support body being received in the pocket and the neck part of the support body protruding through an opening in the front part of the pocket.

In an embodiment, the support body comprises an annular recess in an outside surface, i.e. a surface facing away from the receiving space, which annular recess is configured to receive an edge of the sheet. Thus, for fixing the support body to the instruction sheet during assembly of the instruction sheet, the support body can be inserted into an opening in the sheet, the edge of the opening being received in the annular recess for fixing the support body in the opening relative to the sheet.

In an embodiment, the support body comprises a planar foot part, the foot part extending in a direction substantially parallel to the sheet, which foot part has a bottom surface, which bottom surface preferably is the support surface, and has a top surface, which top surface preferably runs substantially parallel to the bottom surface; and one or more support elements, the support elements extending in a direction away from the bottom surface, which one or more support elements, or at least a part thereof, are configured to engage the outside surface of the sample tube to provide the lateral support for the sample tube.

In a further embodiment, the foot part of the support body is sealed between two sheets, or between two sections of a sheet, and the one or more support elements extend through an opening provided in one of the two sheets or one of the two sections of sheet respectively, to fix the support body to the sheet.

In a further embodiment, the support body is provided with an annular recess configured to receive an edge of the sheet, which annular recess is provided in a section of the support body located between the top surface of the foot part and the one or more support elements, or in a surface of the one or more support elements, said one or more surfaces facing away from the receiving space.

In an embodiment, the support body comprises a single support element in the form of an annular shaped wall that defines the receiving space and the insert opening.

In an embodiment, the support body is combined with a couple element, the support body and the couple element each having a foil engagement surface, wherein the support body and the attachment body are configured for being coupled, e.g. the attachment body being clicked onto the support body, with the foil engagement surfaces facing each other, and clamping a section of the instruction sheet between them to thus fix the support body to the support sheet.

It is submitted that the claimed invention allows for the sample tube to be held in a pocket of the instruction sheet prior to the sample taking process, for example during transport or storage, only to be inserted into the support body by a user when the sample taking process is started. During the sample taking process, the sample tube may be removed from and replaced into the support body, and after the sample taking process has been completed, the sample tube may be reinserted in the pocket.

As an alternative, the claimed invention allows for the sample tube to be held in a support body of the instruction sheet prior to the sample taking process, for example during transport or storage. In such an embodiment, the support body and the sample tube are preferably configured such that the sample tube is securely held, e.g. by friction or by a form coupling, in the support body. During the sample taking process, the sample tube may be removed from and replaced into the support body, and after the sample taking process has been completed, the sample tube may be reinserted in the support body.

In a preferred embodiment, the instruction sheet comprises one relatively narrow panel flanked on opposite sides by a wider panel, which three panels are separated by a folding area such that the panels can be folded on top of each other, and the support body is fixed to a section of the narrow panel, such that the wider panels can be folded on top of each other with the narrow panel, or at least the section of the narrow panel with the support body, extending at an angle to said wider panels and a sample tube inserted in the support body extending in a direction substantially parallel to the wider panels. Thus, the instruction sheet is provided with a booklet shape, more in particular with the configuration of a folded leaflet. Which allows the instruction sheet to be folded into a compact configuration, having a small footprint and thus facilitating the instruction sheet being inserted into an envelope, and unfolded configuration which allows for optimal presentation of information and sample tube to the user.

In a further preferred embodiment, the narrow panel comprises a bottom section a mid-section and a top section, and the support body is fixed to the top section or the bottom section of the narrow panel, such that the wider panels can be folded on top of each other, and the section of the narrow panel with the support body can be folded at an angle to said wider panels and at an angle to the mid-section of the narrow panel, such that a sample tube inserted in the support body extends in a direction substantially parallel to the wider panels and to the mid-section of the narrow panel. When such an embodiment is unfolded, the sample tube, when inserted in the support body, is raised automatically.

A kit according to the invention is configured for shipping a sample, preferably a biological sample, for example a urine sample or a faeces sample to an intended recipient, for example a laboratory, preferably by mail.

The kit is therefore provided with a sample tube in the form of a container with a closure, for example a hinged top or stop. The vial is to be used for holding the sample. The sample can be a liquid sample, a solid state sample, or a mixture of both. Furthermore, additional materials can be held in the vial, for example a liquid preservation material. Sample tubes typically have an elongated shape, having a length two time or more the diameter of the sample holder. Thus, sample tubes can not to be set up on a support surface in a stable, upright position without any support The sample tube can be any kind of tube, e.g. heaving a glass vial a container with a stop or a having a plastic container with a lid screwed onto it, a vial with closures at both ends. Preferably, the closure and/or container are configured for obtaining a sample, for example are provided with an integrated scoop for obtaining a sample.

According to the invention, the support body and the bottom end of the sample tube are shaped such that they cooperate, i.e. have corresponding shapes that enable the bottom end of the sample tube to be received in, or at least to be coupled with, the support body, to enable the support body to support the sample tube in an upright position. Thus, the support body can also be configured to support sample tubes having a spherical shaped bottom end.

In an embodiment, the kit further comprising a sample taking device, for example a spatula, scoop, cotton swab or similar device, which sample taking device preferably is integrated with the cap of the sample tube.

The invention furthermore provides a method for collecting a sample using a kit according to the invention, preferably using a multi pocket instruction sheet according to the invention. The invention furthermore provides an injection molded support body for attachment to a sheet to thus provide an instruction sheet for a kit according to the invention.

Advantageous embodiments of the instruction sheet according to the invention, the kit according to the invention and the method according to the invention are disclosed in the sub claims and in the description, in which the invention is further illustrated and elucidated on the basis of a number of exemplary embodiments, of which some are shown in the schematic drawing. In the figures, components corresponding in terms or construction and/or function are provided with the same last two digits of the reference numbers.

In the figures

Figure 1:
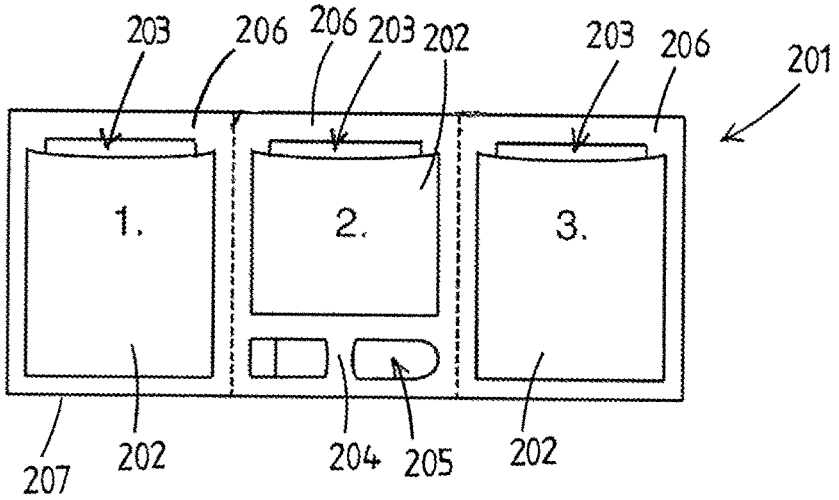
FIG. 1 shows a prior art instruction sheet.

FIG. 1 shows a prior art sample taking kit 201, the kit comprising an instruction sheet 207 and a sample tube 205. The instruction sheet 207 is provided in the form of a multi pocket instruction sheet, or, in other words, a multi pocket instruction bag. The multi pocket instruction sheet 207 comprises multiple pockets 202 for each holding an instruction document 203 and is provided with a loop 204 for holding a sample tube 205. The multi pocket instruction sheet comprises three panels 206, which panels can be folded onto each other to provide the instruction sheet with a compact configuration. In FIG. 1, the instruction sheet is shown unfolded, presenting information and sample tube to a user.

Figure 2:
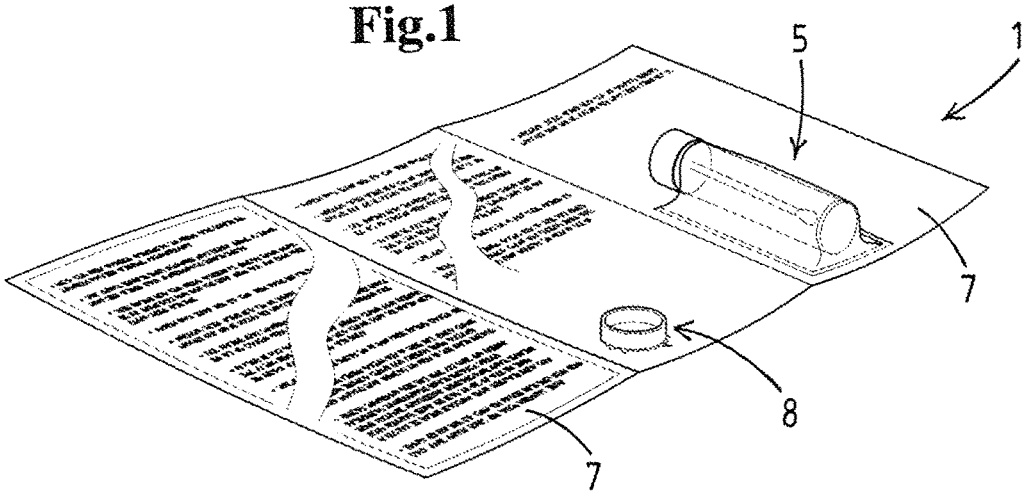
FIG. 2 shows a first exemplary embodiment of a sample taking kit comprising an instruction sheet and a sample tube according to the invention, in a first stage of a sample taking process.

FIG. 2 shows a first exemplary embodiment of sample taking kit 1 according to the invention with an instruction sheet 7 and a sample tube 5, in a first stage of a sample taking process.

According to the claimed invention, the sample taking kit 1 comprises a sample tube 5, a plastic foil instruction sheet 7 and an injection molded support body 8.

The sample tube 5 comprises a container part 9 for holding a sample and a cap 10 for sealing the container part 9.

In the embodiment shown, the instruction sheet comprises three panels 6. The three panels 6 can be folded on top of each other to provide the instruction sheet with a compact configuration. In FIG. 1, the instruction sheet 7 is shown unfolded presenting information and the sample tube to a user.

The plastic foil instruction sheet 7 provides information related to a sample taking process that involves use of the sample tube 5. In the particular embodiment shown, the information is provided in the form of a document 3 held in a pocket 2 on the left most panel 6', and in the form of instructions 11 printed on middle panel 6" and right panel 6'".

In the exemplary embodiment shown, the instruction sheet 7 is provided with a pocket for holding the sample tube 5, which pocket is located on the right most panel 6"

Figure 3:
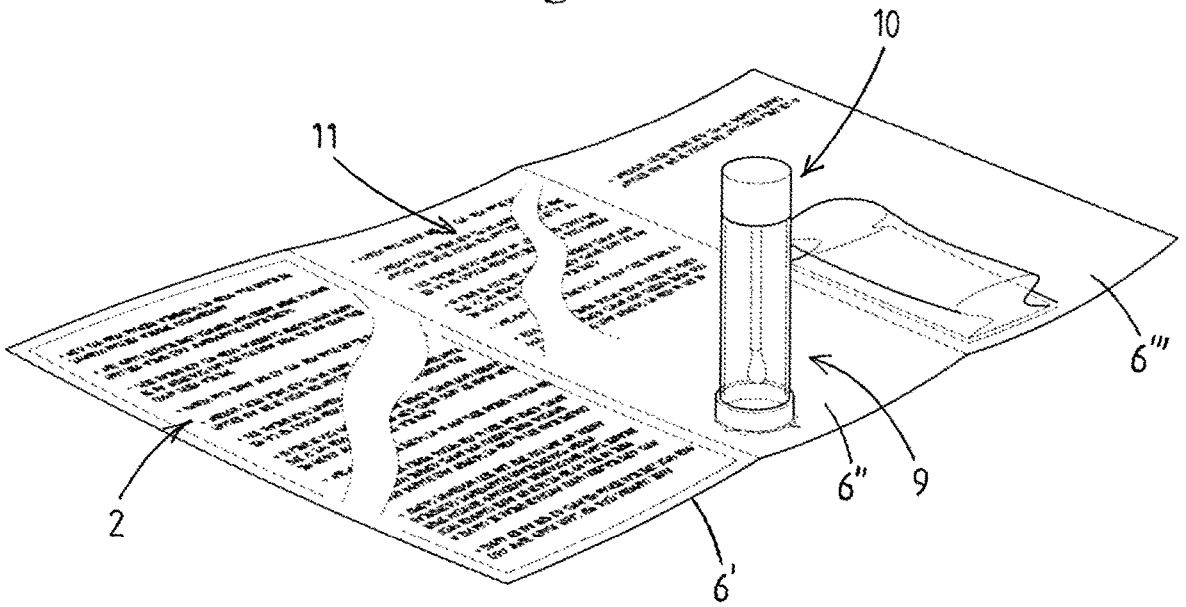
FIG. 3 shows the sample taking kit of FIG. 2 in a second stage of a sample taking process.

According to the invention, the instruction sheet 7 is provided with an injection molded support body 8 adapted to engage the bottom end of the sample tube 5 for supporting the sample tube in an upright position, shown in FIG. 3.

FIG. 3 shows the sample taking kit of FIG. 2 in a second stage of a sample taking process. In this stage, the sample tube 7 has been removed from the pocket and has been inserted, with its bottom end, into the support body 8. Thus, the sample tube is readily available for a user performing the sample taking process.

Figure 4:
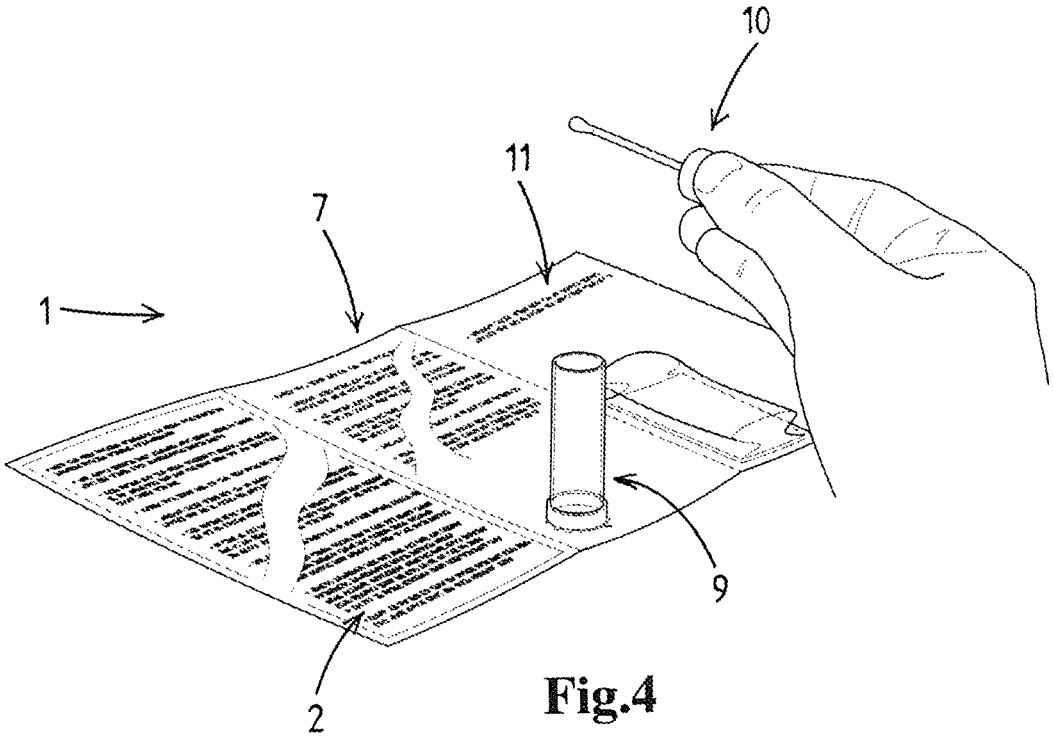
FIG. 4 shows the sample taking kit of FIG. 2 in a third stage of a sample taking process.

FIG. 4 shows the instruction sheet and sample tube of FIG. 2 in a third stage of a sample taking process, in which a user has removed the cap from the sample tube for taking a sample.

Figure 5:
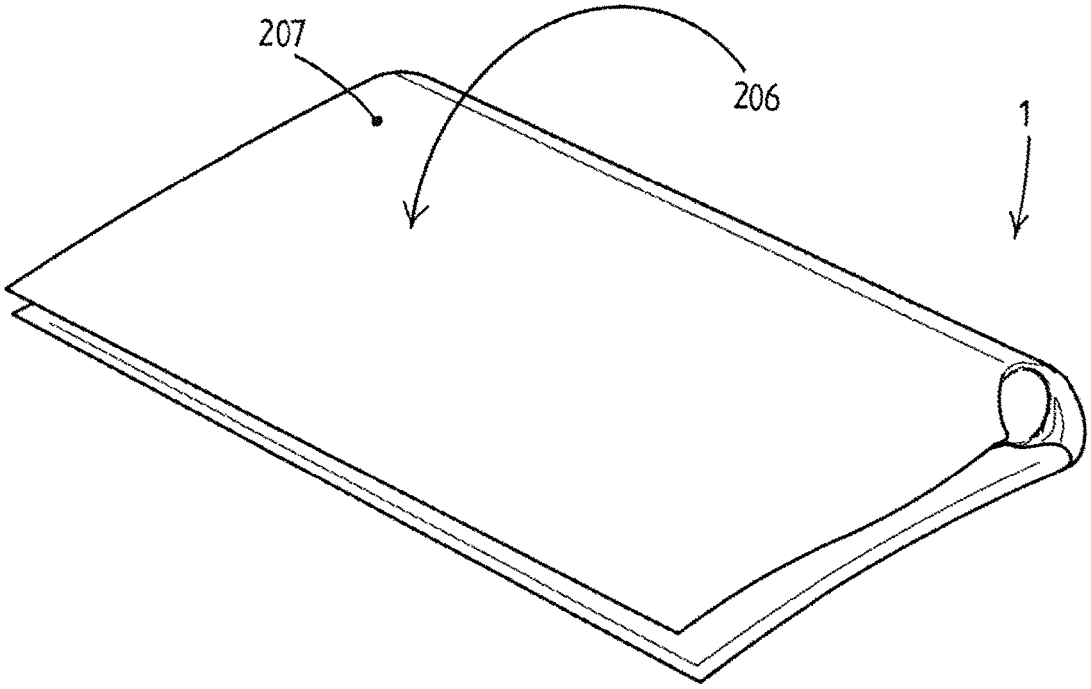
FIG. 5 shows a second exemplary embodiment of a sample taking kit comprising an instruction sheet and a sample tube according to the invention in a first stage of a sample taking process.

FIG. 5 shows a second exemplary embodiment of a sample taking kit 201 according to the invention, comprising an instruction sheet 207 and a sample tube 205 according to the invention.

Figure 6:
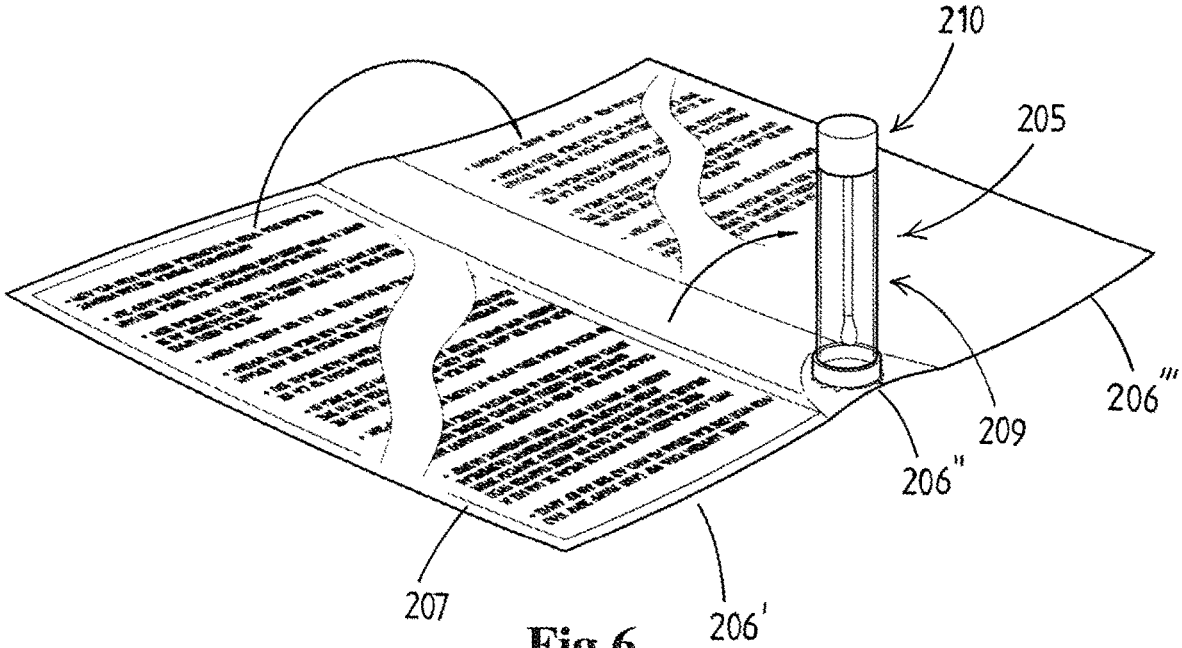
FIG. 6 shows the sample taking kit of FIG. 5 in a second stage of a sample taking process.

FIG. 5 shows the instruction sheet 207 in a folded configuration. FIG. 6 shows the sample taking kit of FIG. 5 in a second stage of a sample taking process, with the instruction sheet unfolded.

In the embodiment shown, the instruction sheet 207 comprises three panels 206.

The instruction sheet 207 comprises a relatively narrow panel 206" flanked on opposite sides by a wider panel 206', 206". The three panels 206 are separated by a folding area such that the panels can be folded on top of each other. The support body 207 is fixed to a section of the narrow panel 206", such that the wider panels 206', 206" can be folded on top of each other with the narrow panel with the support body extending at an angle to said wider panels, which configuration is shown in FIG. 5

The sample tube is inserted in the support body and extends in a direction substantially parallel to the wider panels. Thus, the instruction sheet is provided with a booklet shape, more in particular with the configuration of a folded leaflet. Which allows the instruction sheet to be folded into a compact configuration, having a small footprint and thus facilitating the instruction sheet being inserted into an envelope, and unfolded configuration which allows for optimal presentation of information and sample tube to the user.

Furthermore, in the preferred embodiment shown, the narrow panel 206" comprises a bottom section 206"*a*, a mid-section 206"*b* and a top section 206*b*". The support body 208 is fixed to the bottom section of the narrow panel 206', such that a sample tube inserted in the support body extends in a direction substantially parallel to the wider panels and to the mid-section of the narrow panel. When the instruction sheet 207 is unfolded, the sample tube 205, when inserted in the support body, is raised automatically. The latter is depicted in FIG. 6.

Figure 7:
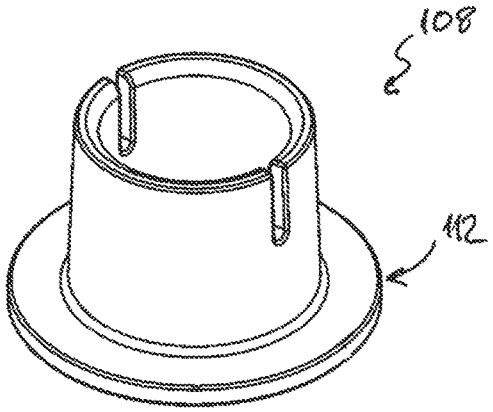
FIG. 7 shows a perspective view of a support body to be combined with a couple element.
Figure 8:
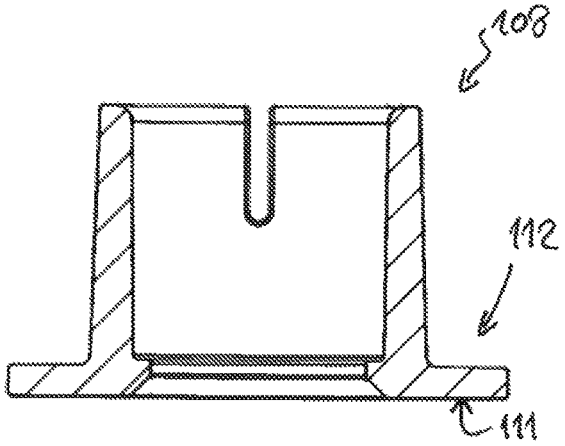
FIG. 8 shows a view in cross section of the support body of FIG. 7.
Figure 9:
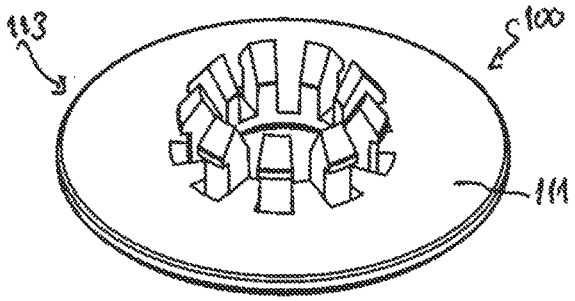
FIG. 9 shows a perspective view of a couple element to be combined with the support body of FIG. 7.
Figure 10:
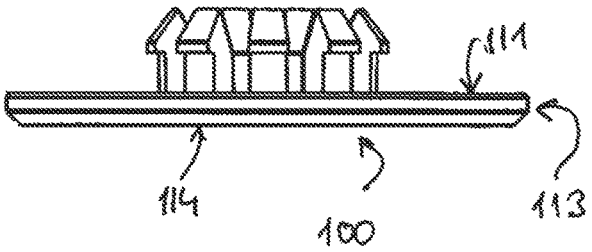
FIG. 10 shows a view in cross section of the couple element of FIG. 9.
Figure 11:
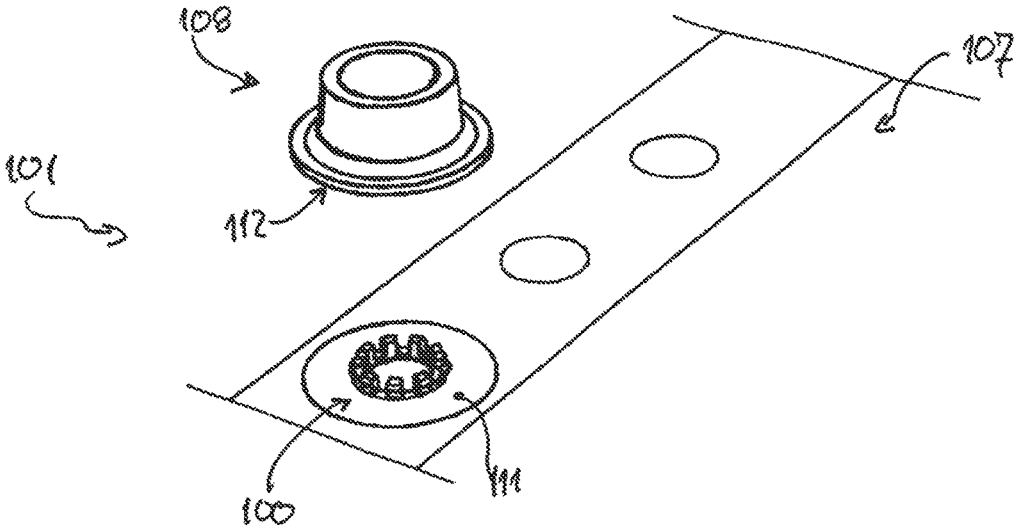
FIG. 11 shows a perspective view of the support body of FIG. 7 and the couple element of FIG. 9 in a pre-assembled state of a sample kit according to the invention.

FIG. 11 depicts an embodiment of a sample kit 101 according to the invention in a pre-assembled state. The sample kit 101 comprises a support body 108, depicted in FIGS. 7 and 8, which support body is to be combined with a couple element 100, depicted in FIGS. 9 and 10. The support body 108 and the couple element 100 each have a foil engagement surface 111.

The support body 108 and the attachment body 100 are configured for being coupled. In the particular embodiment shown the attachment body, or couple element 100, is to be clicked onto the support body 108, with the foil engagement surfaces 111 of the support body and the couple element facing each other. In the embodiment shown, the couple element is provided with click fingers, that protrude through an opening in the sheet, and that are configured to engage the support body. In the pre-assembled state shown, the support body is depicted above the couple element, ready to be lowered and clicked onto the couple element.

When the support body 108 and the couple element 100 are combined, they clamp a section of the instruction sheet 107, provided in the form of a multi pocket instruction bag, between them to thus fix the support body 108 to the instruction sheet.

In the embodiment shown, the support body 108 comprises a planar foot part 112. When the support body 108 and the couple element 100 are combined, the foot part 112 extends in a direction substantially parallel to the sheet 107. The foot part 112 of the support body 108 has a bottom surface, which in the embodiment shown functions as the foil engagement surface 111, and has a top surface. The top surface runs substantially parallel to the bottom surface.

In the embodiment shown, the couple element 100 also comprises a planar foot part 113. When the support body 108 and the couple element 100 are combined, the foot part 113 extends in a direction substantially parallel to the sheet 107. The foot part 113 of the couple element 100 has a bottom surface 114, which in the embodiment shown functions as a support surface, and has a top surface.

Thus, in the embodiment shown, when the support body and the couple element are combined, the sheet of the multi pocket instruction bag is held between the foot parts of the support body and the couple element. In an alternative embodiment, the foot part of the support body is sealed between two sheets, layered on top of each other, to fix the support body to the sheet.

In the embodiment shown, the support body, by combining it with the couple element, is fixed onto the sheet such that the bottom surface of the support body extends in a direction parallel to the sheet of the multi pocket instruction bag, more in particular parallel to a surface of the sheet. Thus, when the instruction sheet is laid out on a support surface such as a table top, to enable a person to take a sample, the bottom surface provides the support body, and thus the sample tube held in the upright position relative to the table top, with extra stability.

In addition, in the embodiment shown in FIGS. 7-11, the couple element 100 has a bottom surface 114 that functions as a support surface of the support body 108. When the instruction sheet is laid out on a support surface such as a table top, to enable a person to take a sample, the support surface 114 is supported by the table top surface, and thus, in addition to the sheet of the multi pocket instruction bag, keeps the sample tube held in the support body, in an upright position relative to the table top during use of the kit by a person for taking a sample.

Thus, when the instruction sheet is for example laid out on a support surface, such as a table top, the bottom surface is supported by the table top surface, and thus provides the support body with extra stability.

In an alternative embodiment, the support body is not provided with a couple element, and the bottom surface of the support body functions as a support surface for placement on e.g. a table top surface, to provide the support body with extra stability.

Thus, the sample kit 101 shown in FIGS. 7-11 comprises an instruction sheet 107, a support body 108, and a sample tube 105 to be used for holding a sample. The sample can be a liquid sample, a solid state sample, or a mixture of both. Furthermore, additional materials can be held in the sample tube, for example a liquid preservation material.

The sample tube 105 has an elongated shape, having a length more than two times the diameter of the sample tube. Therefore, the sample tube can not to be set up on a support surface in a stable, upright position without any support.

According to the invention, the instruction sheet 107 is provided with the support body 108 for holding the sample tube during the sampling taking process. The support body and the bottom end of the sample tube are shaped such that they cooperate, i.e. have corresponding shapes that enable the bottom end of the sample tube to be received in, and be coupled with, the support body, to enable the support body to support the sample tube in an upright position.

By securing the sample tube onto the instruction sheet, more in particular by supporting the sample tube in the upright position on the instruction sheet, and thus in an upright position relative to a support surface onto which the instruction sheet is laid out, the sample tube is always readily available for a user in the process of taking a sample, the process of taking a sample comprising the instruction sheet being laid down on a support surface, for example a table surface, to present a user with the information held in the pockets and/or printed on the instruction sheet.

The laid down instruction sheet thus supports the sample tube in an upright position relative to a support surface, which is depicted in FIGS. 3, 4 and 6.

Because the sheet and support body position the sample tube in the upright position, a sample can easily be inserted in the sample tube. The person taking the sample does not need to hold or pick up the sample tube during or after collecting the actual sample to insert the sample into the sample tube. With an instruction sheet according to the claimed invention, the sample tube is thus readily available to the user taking a sample. Thus, the invention provides an alternative sampling kit which facilitates the sample taking process, more in particular, that facilitates collecting the sample.

Figure 12:
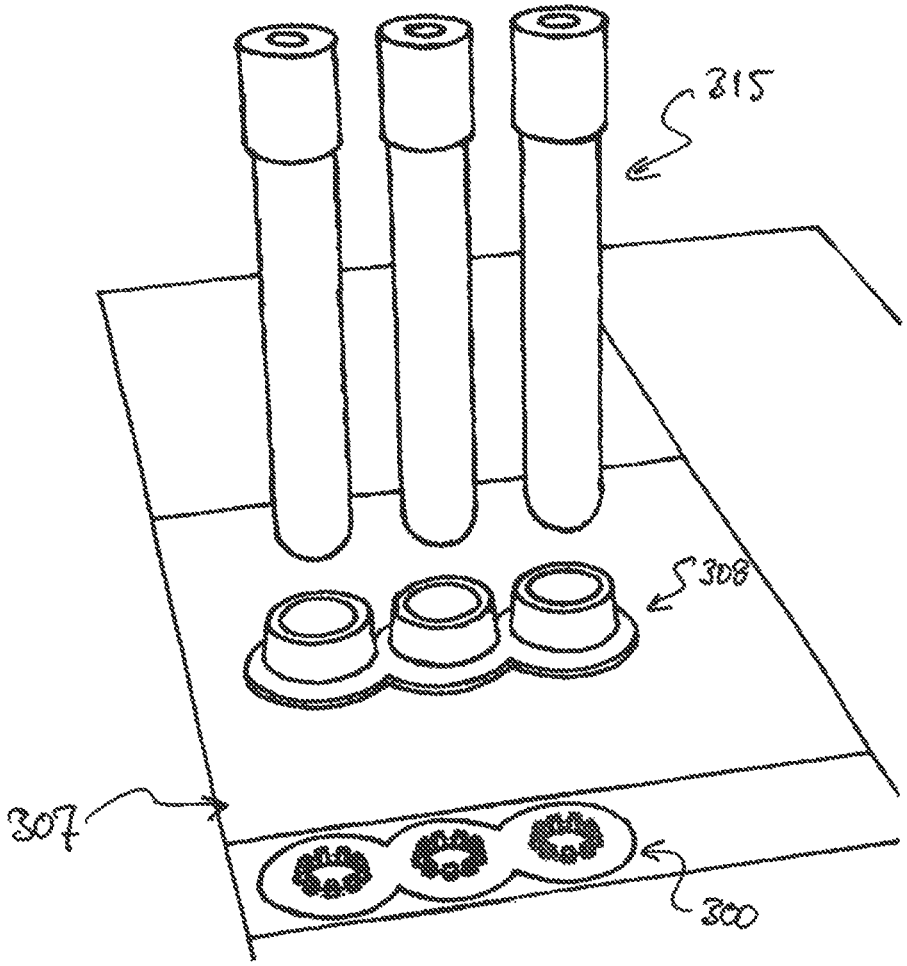
FIG. 12 shows a perspective view of an alternative support body and an associated couple element in a pre-assembled state of a sample kit.

FIG. 12 shows a perspective view of an alternative support body 308 and an associated couple element 300 in a pre-assembled state of a sample kit. The support body 308 and the support element 300 are, similar to the support body 108 and couple element 100 shown in FIGS. 7-11, to be combined to fix the support body onto the instruction sheet 307 of the multi pocket instruction bag. The support body 308 differs from the support body 108 in that it is configured to support multiple sample tubes 315 having a spherical shaped bottom end.

The invention claimed is:

1. A sample taking kit, the sample taking kit comprising:

a sample tube, the sample tube comprising a container part for holding a sample and a cap for sealing the container; and a flexible plastic instruction sheet, the flexible plastic instruction sheet comprising a first panel and a second panel which are separated from each other by a folding area, such that the second panel is foldable onto the first panel, wherein the flexible plastic instruction sheet provide information related to a sample taking process that involves use of the sample tube, the information being provided in the form of one or more documents held in one or more pockets of the flexible plastic instruction sheet and/or being printed on the flexible plastic instruction sheet, wherein the flexible plastic instruction sheet is provided with an injection molded support body, the support body having a top part configured to engage a bottom end of the sample tube, and a bottom part configured for placement on a tabletop, for supporting the sample tube in an upright position with respect to the tabletop, wherein the support body is fixed to the flexible plastic instruction sheet by the top part and the bottom part coupled together with the flexible plastic instruction sheet clamped therebetween, and the fixation of the support body to the flexible plastic instruction sheet is configured in such a manner that a bottom surface, which engages flexible plastic instruction sheet, of the top part is parallel with the tabletop when the flexible plastic instruction sheet is unfolded and placed on the tabletop in order for supporting the sample tube in the upright position with respect to the tabletop, and wherein a dimension of the support body is configured in such a manner that the folded flexible plastic instruction sheet with the support body therein fits in a postal envelope to enable the flexible plastic instruction sheet to be sent by mail.

2. The sample taking kit according to claim 1, wherein a bottom surface of the support body extends in a direction parallel to the flexible plastic instruction sheet.

3. The sample taking kit according to claim 2, wherein the bottom surface has an outer contour having a diameter, and wherein the diameter is at least one and a half times the cross section of the sample tube to be held by the support body.

4. The sample taking kit according to claim 1, wherein the support body defines a sample tube receiving space for receiving the bottom end of the sample tube, and defines an insert opening for inserting the bottom end of the sample tube into the receiving space, the insert opening being dimensioned such that, when the bottom end of the sample tube is inserted in the receiving space, the support body engages an outside surface of the sample tube to provide support for the sample tube in a lateral direction.

5. The sample taking kit according to claim 4, wherein a contour of the insert opening is dimensioned for clamping the sample tube in the insert opening.

6. The sample taking kit according to claim 4, wherein a contour of the insert opening is dimensioned for clamping the sample tube in the insert opening, and the insert opening is provided with a flexible material to provide an additional clamping force.

7. The sample taking kit according to claim 1, wherein the support body comprises an annular recess in an outside surface, the annular recess being configured to receive an edge of the flexible plastic instruction sheet, such that for fixing the support body to the flexible plastic instruction sheet during assembly of the instruction sheet, the support body can be inserted into an opening in the flexible plastic instruction sheet, the edge of the opening being received in the annular recess for fixing the support body relative to the flexible plastic instruction sheet.

8. The sample taking kit according to claim 1, wherein the top part of the support body comprises:

a planar foot part, the foot part extending in a direction parallel to the flexible plastic instruction sheet, the foot part having a bottom surface and a top surface; and one or more support elements, the support elements extending in a direction away from the bottom surface, the one or more support elements being configured to engage an outside surface of the sample tube to provide a lateral support for the sample tube.

9. The sample taking kit according to claim 8, wherein the foot part of the support body is sealed between two sheets, or between two sections of a sheet, and the one or more support elements extend through an opening provided in one of the two sheets or one of the two sections of a sheet respectively, to fix the support body to the sheet.

10. The sample taking kit according to claim 1, wherein the top part and bottom part of the support body each having a engagement surface, wherein the top part and bottom part of the support body are configured for being coupled with the engagement surfaces facing each other, and clamping a section of the flexible plastic instruction sheet between them to thus fix the support body to the flexible plastic instruction sheet.

11. The sample taking kit according to claim 1, wherein the flexible plastic instruction sheet further comprises one relatively narrow panel between the first panel and the second panel, the three panels being separated by a folding area such that the first and second panels can be folded on top of each other, and wherein the support body is fixed to a section of the narrow panel, such that the first and second panels can be folded on top of each other with the section of the narrow panel with the support body extending at an angle to said first and second panels and the sample tube inserted in the support body extending in a direction parallel to the first and second panels.

12. The sample taking kit according to claim 11, wherein the narrow panel comprises a bottom section, a mid-section and a top section, and wherein the support body is fixed to the top section or the bottom section of the narrow panel, such that the first and second panels can be folded on top of each other, and the section of the narrow panel with the support body can be folded at an angle to said first and second panels and at an angle to the mid-section of the narrow panel, such that the sample tube inserted in the support body extends in a direction parallel to the first and second panels and to the mid-section of the narrow panel.

13. The sample taking kit according to claim 1, wherein the flexible plastic instruction sheet comprises a pocket for holding the sample tube.

14. The sample taking kit according to claim 1, wherein the flexible plastic instruction sheet is a multi-pocket instruction sheet, comprising multiple pockets for each holding an instruction sheet or a sample tube, and wherein the multi pocket instruction sheet is configured for presenting instructions and a sample tube to a nonprofessional user in an ordered, predetermined sequence, thus guiding said user through the process of taking a sample.

15. The sample taking kit according to claim 1, wherein the flexible plastic instruction sheet is a multi-pocket instruction sheet, comprising multiple pockets for each holding an instruction sheet or a sample tube, and wherein the pockets of the multi pocket instruction sheet are provided with signs and/or symbols and/or letters and/or numbers and/or pictures, that indicate the user in which sequence the content of the pockets has to be consulted.

16. The sample taking kit according to claim 15, wherein the flexible plastic instruction sheet can be folded between a compact configuration, in which the instruction sheet fits into a regular postal envelope, and an unfolded configuration, in which the instruction sheet does not fit into the regular postal envelope.

17. The sample taking kit according to claim 1, wherein the flexible plastic instruction sheet is a multi-pocket instruction sheet, comprising multiple pockets for each holding an instruction sheet or a sample tube, wherein the pockets of the multi pocket instruction sheet are provided such that one or more of the pockets can be folded upon one another to provide the multi pocket instruction sheet with a compact configuration and thus facilitate transport.

18. The sample taking kit according to claim 1, wherein the kit further comprises a sample taking device.

19. The sample taking kit according to claim 18, wherein the sample taking device is integrated with the cap of the sample tube.

20. A method for providing a biological sample, the method comprising:

using a sample taking kit, the sample kit comprising:

a sample tube, the sample tube comprising a container part for holding a sample and a cap for sealing the container; and a flexible plastic instruction sheet, the flexible plastic instruction sheet comprising a first panel and a second panel which are separated from each other by a folding area, such that the second panel is foldable onto the first panel, wherein the flexible plastic instruction sheet provide information related to a sample taking process that involves use of the sample tube, the information being provided in the form of one or more documents held in one or more pockets of the flexible plastic instruction sheet and/or being printed on the instruction sheet, wherein the flexible plastic instruction sheet is provided with an injection molded support body, the support body having a top part configured to engage a bottom end of the sample tube, and a bottom part configured for placement on a tabletop, for supporting the sample tube in an upright position with respect to the tabletop, wherein the support body is fixed to the flexible plastic instruction sheet by the top part and the bottom part coupled together with the flexible plastic instruction sheet clamped therebetween, and the fixation of the support body to the flexible plastic instruction sheet is configured in such a manner that a bottom surface, which engages flexible plastic instruction sheet, of the top part is parallel with the tabletop when the flexible plastic instruction sheet is unfolded and placed on the tabletop in order for supporting the sample tube in the upright position with respect to the tabletop, and wherein a dimension of the support body is configured in such a manner that the folded flexible plastic instruction sheet with the support body therein fits in a postal envelope to enable the flexible plastic instruction sheet to be sent by mail;

placing the flexible plastic instruction sheet with unfolded first and second panels on the tabletop, with the support body supporting the sample tube in the upright position with respect to the tabletop;

inserting a sample in the sample tube;

folding the first and second panels of the flexible plastic instruction sheet into each other with the sample tube therebetween; and inserting the flexible plastic instruction sheet with the sample tube therein into the postal envelope to be sent by mail.

* * * * *